US008600464B2

(12) United States Patent
Edwards et al.

(10) Patent No.: US 8,600,464 B2
(45) Date of Patent: Dec. 3, 2013

(54) SUPERCONDUCTING FAULT CURRENT LIMITER

(75) Inventors: Huw L. Edwards, Derby (GB); Christopher G. Bright, Nottingham (GB); Stephen M. Husband, Derby (GB)

(73) Assignee: Rolls-Royce PLC, London (GB)

( * ) Notice: Subject to any disclaimer, the term of this patent is extended or adjusted under 35 U.S.C. 154(b) by 0 days.

(21) Appl. No.: 13/618,223

(22) Filed: Sep. 14, 2012

(65) Prior Publication Data

US 2013/0090243 A1 Apr. 11, 2013

(30) Foreign Application Priority Data

Oct. 10, 2011 (GB) ..... 1117381

(51) Int. Cl.
*H01F 6/06* (2006.01)

(52) U.S. Cl.
USPC ..... 505/163; 505/220

(58) Field of Classification Search
USPC ..... 505/16, 220; 361/19
See application file for complete search history.

(56) References Cited

U.S. PATENT DOCUMENTS

| | | | | |
|---|---|---|---|---|
| 8,238,988 | B2 * | 8/2012 | Stautner | 505/162 |
| 8,280,467 | B2 * | 10/2012 | Yuan et al. | 505/163 |
| 8,295,900 | B2 * | 10/2012 | Jang et al. | 505/163 |
| 8,437,819 | B2 * | 5/2013 | Takayasu et al. | 505/230 |
| 2003/0191028 | A1 | 10/2003 | Neumüller et al. | |

FOREIGN PATENT DOCUMENTS

| | | |
|---|---|---|
| WO | WO 2004/038817 | 5/2004 |
| WO | WO 2009/006666 A1 | 1/2009 |

OTHER PUBLICATIONS

Feb. 7, 2012 Search Report issued in British Application No. GB1117381.2.

* cited by examiner

*Primary Examiner* — Colleen Dunn
(74) *Attorney, Agent, or Firm* — Oliff & Berridge, PLC

(57) ABSTRACT

This invention relates to a superconducting fault current limiter, including: an input segment of an input transformer core and an output segment of an output transformer, each segment having a first end and a second end; a length of superconductor which forms a winding around the input segment and a winding around output segment, wherein the windings are connected in series to form a closed loop; a cryostat in which the superconductor is housed; wherein each end of the input and output segments are exposed to the exterior of the cryostat.

10 Claims, 2 Drawing Sheets

SUPERCONDUCTING FAULT CURRENT LIMITER

TECHNICAL FIELD OF INVENTION

This invention relates to superconducting fault current limiters, SFCLs.

BACKGROUND OF INVENTION

Superconducting fault current limiters are well known in the art and rely on the quench of a length of superconductor and its rise in impendence in response to a fault current so as to limit the size of the fault current. The rise in impedance limits the fault current which can flow. Hence, SFCLs can be used alone or with other switch gear which is sized to switch the much reduced fault current. Such SFCLs are used (and being proposed for use) in a number of industries, for example, within national electricity supply grids.

However, prior art SFCLs are generally hardwired into electrical networks making maintenance and exchange of the units difficult and time consuming, or have electrical conductors passing through a wall of a cryostat to allow connection, thereby making the systems thermally lossy.

The present invention seeks to provide an SFCL which can be more easily maintained.

STATEMENT OF INVENTION

In a first aspect, the present invention provides a superconducting fault current limiter, comprising: an input segment of an input transformer core and an output segment of an output transformer, each segment having a first end and a second end; a length of superconductor which forms a winding around the input segment and a winding around output segment, wherein the windings are connected in series to form a closed loop; a cryostat in which the superconductor is housed; wherein each end of the input and output segments are exposed to the exterior of the cryostat.

Providing a superconducting fault current limiter, SFCL, with transformer core segments allows the SFCL to be removed from an electrical network whilst keeping the cryostat intact. This makes maintenance of the SFCL easier.

The length of superconductor may include a trigger portion which is configured to preferentially quench in the event of a fault current during normal use.

The superconductor may be arranged in a coil and may be configured to magnetically quench when a current flowing through the coil is above a predetermined threshold.

The segments may be made from a material having a thermal conductivity below 5 W $m^{-1}K^{-1}$. The segments may be made from a ferrite material. Each segment may include the first part of a two part connection. Either or both of the input segments may be external to the cryostat.

In a second aspect, the present invention provides an electrical network comprising: the superconducting fault current limiter of the first aspect and an input transformer core and an output transformer core, each having a magnetic core of which the SFCL segments are part of, each core having an input winding external to the cryostat and an output winding external to the cryostat.

The transformer cores may include a saturation zone which is configured to preferentially magnetically saturate relative to the other portions of the transformer core.

The ratio of the external to internal windings on the input and output transformer cores may be 1:1. It may also be variable by including tap changers, the induction (X/R) ratio of the system could be used to control the rate of change of current limitation offered by the FCL.

Reducing the inductance of the transformer using known methods could be desirable to increase the rate of response of the FCL. This could involve core design, choice of core materials, design for saturation during a fault, coil design (designed to quench fast, immediately reducing the inductance).

DETAILED DESCRIPTION OF INVENTION

SFCL's are well known in the art and essentially include a length of the superconductor which is configured to quench under certain operating conditions, thereby becoming highly resistive (in the case of a resistive SFCL) and limiting the current flow.

Quench occurs when one or more of an excess temperature, magnetic field or current density occurs within the superconductor. Thus, in the event of a fault current for example, the current density within the superconductor will increase beyond a predetermined design limit and a quench will occur. Typical materials for a SFCL are, amongst others, Bismuth Strontium Calcium Copper Oxide (BSCCO), Yttrium Barium Copper Oxide (YBCO) or Magnesium Diboride ($MgB_2$).

Generally, SFCLs form part of an electrical network and are connected between an electrical source and an electrical load and provide a method of limiting fault current, possibly in combination with circuit breaking devices, to ensure a fault can be safely isolated. Such a network may include but is not limited to a propulsion system on an airborne vehicle or marine vessel, or as part of a mains grid or renewable energy network, such as a wind farm.

Figure 1A:
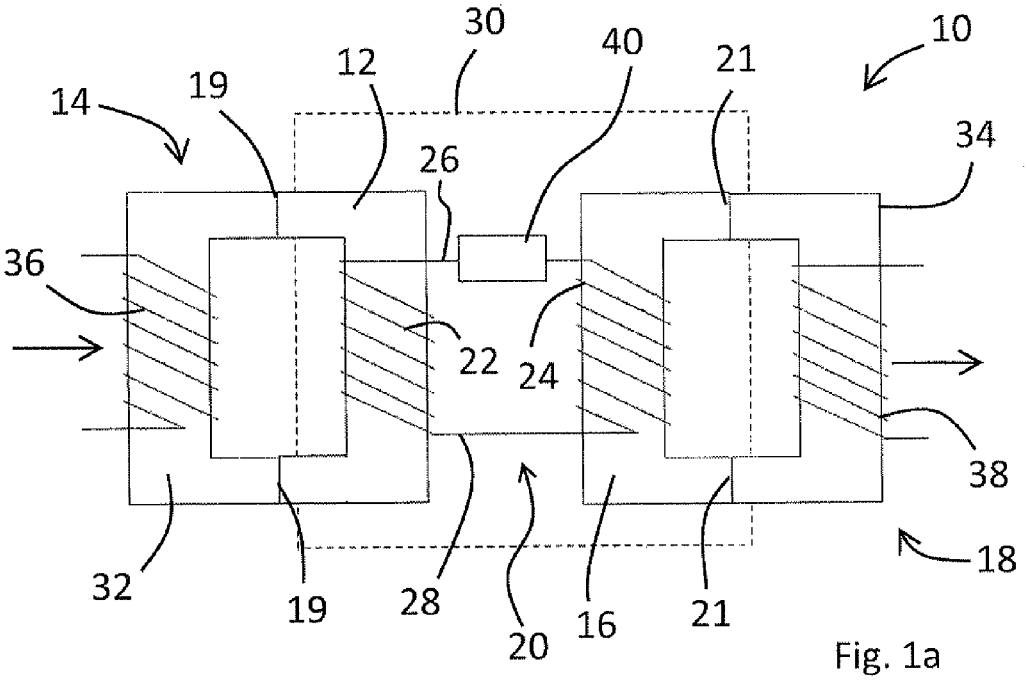
FIG. 1*a* shows a schematic representation of an electrical network having an SFCL according to the present invention.

FIG. 1 shows a superconducting fault current limiter, SFCL, 10 according to the present invention. The SFCL 10 includes a segment 12 of an input transformer core 14, a segment 16 of an output transformer core 18, and a length of superconductor 20. The length of superconductor 20 forms a winding 22, 24 around a mid-portion of each of the core segments 12, 16, with the two windings 22, 24 being connected in series via connection lines 26, 28 which extend between the corresponding ends of the windings 22, 24 and the core segments 12, 16.

The length of superconductor 20 and the majority of the core segments 12, 16 are located within a cryostat 30 which is coupled to a source of cooling such as liquid helium such that the superconductor 20 can be cooled to below the critical temperature of the chosen superconducting material. Hence, as will be appreciated, a working system would include some form of refrigeration unit to provide a coolant and the necessary pipe work etc, which is not shown in the drawings for the sake of clarity.

The input and output transformer cores 14, 18 are each split 19, 21, into two segments. One segment is the internal segment 12, 16 located within the cryostat, as described above, and with ends exposed to the exterior of the cryostat 30. The remaining segments are external segments 32, 34 of the input 14 and output 18 core, as defined by splits in the cores, and are located outside of the cryostat 30. Each external segment has respective external input and output windings 36, 38 wrapped around them. The ends of the external segments 32, 34 mate with the ends of the internal segments 12, 16 so as to provide a closed magnetic circuit, thereby providing a transformer arrangement.

In use, the external input winding 36 is connected to an electrical source (not shown), and the external output winding 38 is connected to an electrical load (not shown). Thus, when the external windings 36, 38 of the input and output transformers 14, 18 are connected to a source and a load, respectively, current flows through the SFCL via the segmented input and output transformers 12, 16 and into the load.

The purpose of having split transformer cores 14, 18 is to allow for the SFCL 10 to be removed quickly and easily from the electrical network. This allows for a rapid changeover of an SFCL 10 in the event of a fault or when maintenance is required. For example, a replacement superconducting fault current limiter could be advantageously cooled prior to being placed in the electrical network. This would reduce the amount of down time the network would have to suffer when maintenance is required.

A further advantage of the present invention is that it allows the thermal efficiency of the system to be increased. This is because the energy is transferred through the wall of the cryostat 30 using a magnetic flux guide in the form of the transformer core, rather than an electrical conductor, and it is possible to choose a magnetic flux guide which has a low thermal conductivity helps prevent the ingress of heat into the cryostat 30. The transformer cores 14, 18 of the described embodiment of a ferrite material a thermal conductivity of 5 $W\ m^{-1}K^{-1}$ (or less). However, the skilled person will appreciate that other materials which have a lower thermal conductivity and relatively high magnetic permeability (ferrites, for example, typically have a relative permeability of greater than 640 or absolute figure of greater than $8\times10^{-4}$ H/m) may be equally applicable to the invention.

The length of superconductor 20 can advantageously include a trigger portion. The trigger portion of the described embodiment is in the form of a reduced cross section 40 of superconductor which is located along one of the connection lines 26 which extends between the two windings. The trigger portion is configured to quench preferentially in favour of the other portions of the electrical circuit. Hence, when a quench occurs the length of superconductor 20 which experiences the excess current density and corresponding thermal rise is relatively short and the cooling burden on the cryogenic system is reduced when the fault is removed and re-cooling is required.

Another option for a trigger portion is to include a portion of winding which is placed around a magnetic core and is arranged so as to have a larger self inductance such that a fault current would produce a magnetic flux which would result in a quench of that portion of superconductor in preference to the other portions of the superconducting circuit.

The size of the core of the transformers could also be used to contribute to a magnetic quench fault current limiting effect, by altering their cross sectional surface area of the core in plane perpendicular to the flow of flux through the core, so that the magnetic flux density applied by the core to the superconductor is greater than elsewhere. In this case, the core cross section area would be designed not to saturate, to allow flux density to rise and the coil to magnetically quench.

A yet further option would be to provide the core with a magnetic saturation zone having a reduced cross section such that it magnetically saturates in the event of a fault current, thereby resulting in thermal dissipation and a rise in the winding temperature. Further, the saturation in such a case may lead to a reduction in the windings' inductance which may allow the SFCL to respond more rapidly to a fault. In one embodiment, the saturation of the transformer cores could be increased by making one or more portions of the core from a magnetic material which differs from other parts of the core in that it has a lower saturation point.

Designing the core such that it saturates in a fault could also be advantageous to decrease the inductance of the core reducing the aperiodic (DC) component of fault current and easing the duty imposed on switchgear. A reduced aperiodic component also reduces the risk of magnetically saturating current transformers used in electrical protection and control systems.

Figure 1B:
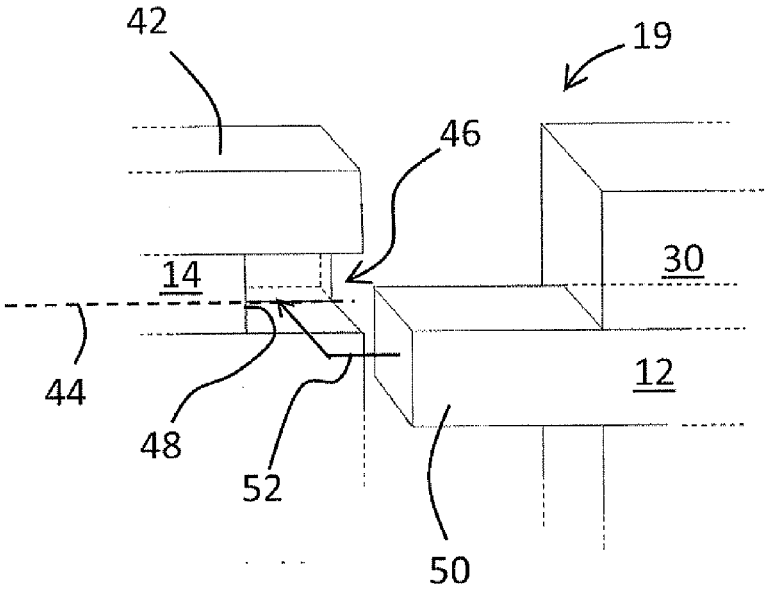
FIG. 1*b* shows a schematic cross-sectional close up of the split core shown in FIG. 1*a*.

FIG. 1*b* shows a schematic cross-sectional close up of the transformer core split 19 shown in FIG. 1, prior to assembly. The core includes a two part connection in which an end of the internal segment 12 projects from the wall of the cryostat 30 and an end of the external segment 14 which is located on the exterior of the cryostat 30 and includes a recess for receiving the projection.

The external segment 14 is surrounded on three sides by with thick thermal insulation 42, for example, polyurethane foam or expanded polystyrene The ends of the insulation and magnetic core are offset relative to each other along the longitudinal axis 44 of the core 14 such that a recess 46 is provided within the end of the insulation, the distal inner surface of the recess 46 being provided by the mating surface 48 of the magnetic core 14.

The end portion of the internal segment 12 is surrounded by the thermal insulation of the cryostat 30 and protrudes to provide a protruding portion 50. The protruding portion 50 of the internal segment 12 is sized and shaped to correspond to the recess 46 within the insulation of the external segment 14.

To engage the internal 12 and external 14 segments, the SFCL 10 is laterally moved towards the recess 52 such that it slots into the open side of the recess with the corresponding end faces of the magnetic core and insulation slidingly abutting one another upon insertion.

Once inserted, the open side of the core can be covered with a further portion of thermal insulation (not shown) so as to maintain the thermal efficiency of the design.

In another embodiment, the split in the cores can be mechanical enhanced so as to strengthen the joint and help reduce vibration caused by the alternating magnetic flux within the core. Hence, the joint can include a two part fastener which, once secured, can be covered over with thermal insulation. Any suitable mechanical fastener or coupling device may be used to secure the two segments together. For example, the arrangement may include a simple nut and bolt arrangement or some other quick release clamping mechanism. Further, the recess in the insulation shown in FIG. 1*b* in combination with the projection portion can be considered to be a two part fastener if it provides some retention of the two components.

The position of the split relative to the cryostat can be varied to suite a particular method of coupling the cores together. Hence, the core segments may protrude from the cryostat so as to stand proud so as to form a protruding portion (as shown in the LHS of the arrangement of FIG. 1*a*), or reside within the cryostat so as to provide a recess into which the external segment can be mated (as shown in the RHS of the arrangement of FIG. 1*a*). In another embodiment, one or more of the end portions of the internal segments ay be flush with the surface of the cryostat.

Figure 2:
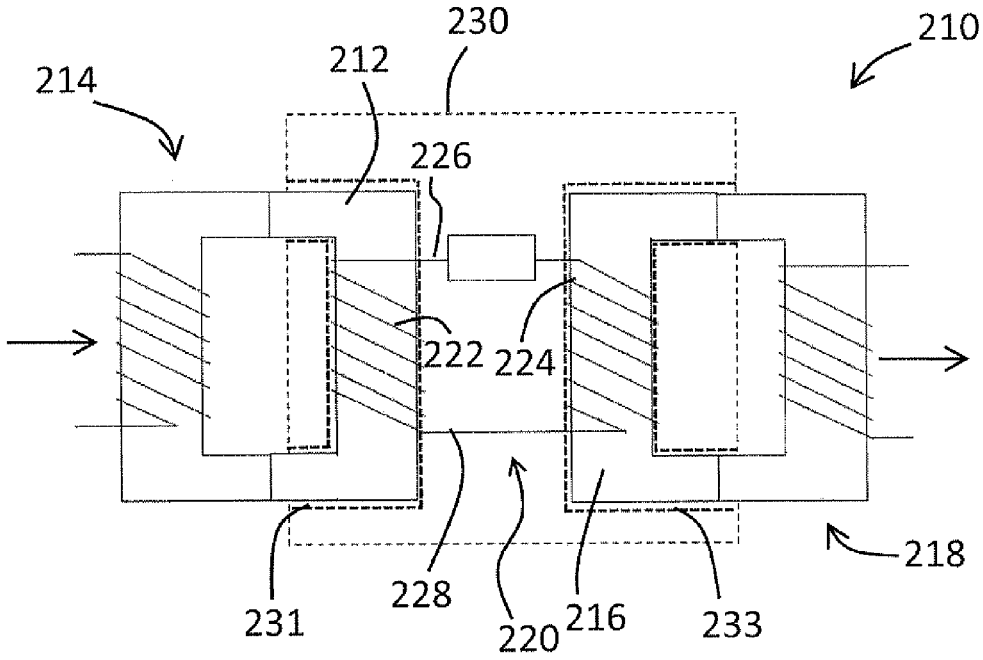
FIG. 2 shows a schematic representation of an alternative embodiment.

FIG. 2 shows a further embodiment in which the SFCL 210 includes a segment 212 of an input transformer core 214, a segment 216 of an output transformer core 218, and a length of superconductor 220. The length of superconductor 220 forms a winding 222, 224 around a mid-portion of each of the core segments 212, 216, with the two windings 222, 224 being connected in series via connection lines 226, 228 which extend between the corresponding ends of the windings 222, 224 and the core segments 212, 216 as with the previously described embodiment. However, here the segments 212, 216 are located outside of the cryostat 230 in external channels 231, 233 which run through the thermal insulation of the cryostat 230 with the superconducting windings 222, 224 located inside of the cryostat 230. This improves the thermal integrity of the system.

Figure 3:
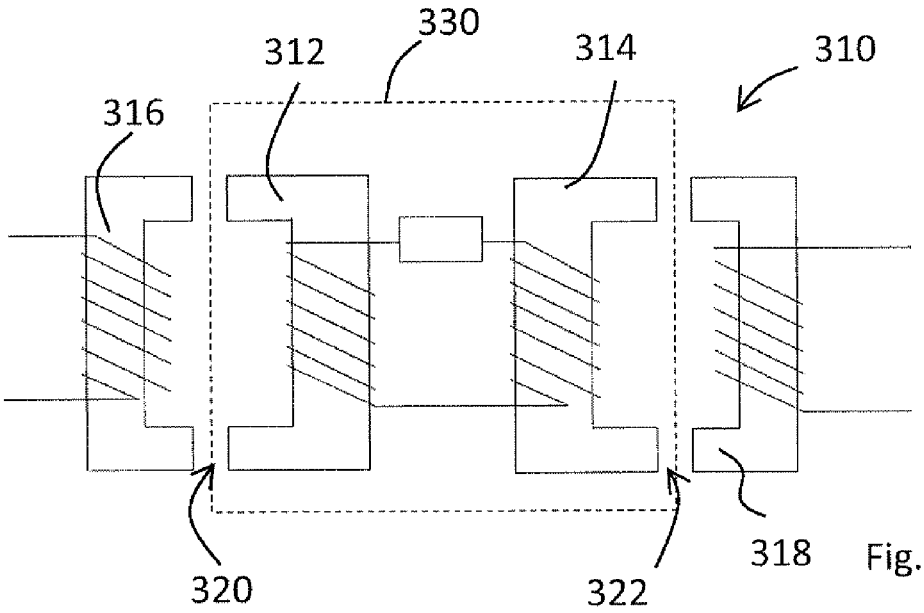
FIG. 3 shows a schematic representation of a yet further alternative embodiment.

FIG. 3 shows a further embodiment of the SFCL 310 in which the transformer segments 312, 314, 316, 318 are separated by respective gaps 320, 322 in which the cryostat 330 wall sits. In this configuration, the internal segments 312, 316 are entirely enclosed within the cryostat 330 and so the efficiency of the magnetic circuit will be reduced due to the reluctance of the gaps 320, 322. However, the thermal integrity of the cryostat 330 is maintained and the efficiency of the cryogenic system increased due to the removal of the thermally conductive path of the transformer core which no longer passes through the cryostat 330 wall.

In a yet further embodiment, the SFCL may include a control system that monitors the operating condition of the SFCL and the response of the current flow therethrough. The information gathered by the controller could then be used to help deduce the nature of a fault when it occurs and act accordingly. For example, the controller may be able to discern when a particular piece of equipment develops a fault from the ramp up of the voltage across the SFCL as its resistance increases. It may then be possible to selectively isolate this piece of equipment.

The fault itself can be detected and located using known electrical protection techniques and the fault current interrupted by known designs of switchgear operated by electrical protection. Measurements of the superconductor, in particular the current flowing through it, change in voltage its electrical resistance, its increase in temperature and its self magnetic field , increase in field could be used in by known electrical protection techniques.

The control system could also be configured to increase or decrease the flow of coolant in the cryostat, which may be advantageous when the SFCL is trying to recover from a fault or it is desirable to alter the quench point of the SFCL. Advantageously, a plurality of SFCL's could receive coolant a single cryostat.

The specific embodiments described above should not be taken as a limitation of the scope invention which is defined by the claims.

For example, the embodiments described above relate to a single phase SFCL. However, it will be appreciated that the invention is applicable to a three phase system or other numbers of phases without departing from the scope of the invention.

As will also be appreciated, the ratios of turns of the internal and external windings may be chosen to provide a voltage conversion through the SFCL, or may simply be a 1:1 ratio. In some embodiments, each transformer has more than two windings with other windings connected to other AC systems. Possibly a transformer tap changer could be used to change the magnetic flux density of a core to control the magnetic saturation, allowing for greater control of a magnetic quench. Further, the ratios of the transformers are designed so that the fault current limiter operates at a voltage and current different to the systems being protected. Possibly the transformers offer electrical isolation between two or more electrical systems.

The invention claimed is:

1. A superconducting fault current limiter, comprising:

an input segment of an input transformer core and an output segment of an output transformer, each segment having a first end and a second end;

a length of superconductor which forms a winding around the input segment and a winding around output segment, wherein the windings are connected in series to form a closed loop;

a cryostat in which the superconductor is housed;

wherein each end of the input and output segments are exposed to the exterior of the cryostat.

2. A superconducting fault current limiter as claimed in claim 1 wherein the length of superconductor includes a trigger portion which is configured to quench in the event of a fault current during normal use.

3. A superconducting fault current limiter as claimed in claim 1 wherein the superconductor is arranged in a coil and is configured to magnetically quench when a current flowing through the coil is above a predetermined threshold.

4. A superconducting fault current limiter as claimed in claim 1 wherein the segments are made from a material having a thermal conductivity below 5 W $m^{-1}K^{-1}$.

5. A superconducting fault current limiter as claimed in claim 1 wherein the segments are made from a ferrite material.

6. A superconducting fault current limiter as claimed in claim 1 wherein each segment end includes the first part of a two part connection.

7. A superconducting fault current limiter as claimed in claim 1 wherein either or both of the input segments are external to the cryostat.

8. An electrical network comprising:

a superconducting fault current limiter of claim 1 an input transformer core and an output transformer core, each having a magnetic core of which the SFCL segments are part of, each core having an input winding external to the cryostat and an output winding external to the cryostat.

9. An electrical network as claimed in claim 8 wherein the transformer cores include a saturation zone which is configured to magnetically saturate relative to the other portions of the transformer core.

10. An electrical network as claimed in claim 8 wherein the ratio of external to internal windings on the input and output transformer cores are 1:1.

* * * * *